US008651040B2

(12) United States Patent
Heideman et al.

(10) Patent No.: US 8,651,040 B2
(45) Date of Patent: Feb. 18, 2014

(54) DISCONNECTABLE MOORING SYSTEM AND METHOD FOR DISCONNECTING OR RECONNECTING IT

(75) Inventors: Rik Robert Heideman, Haarlem (NL); Patrizio Giovanni Matia Ottolini, Voorhout (NL); Clemens Gerardus Johannes Maria Van Der Nat, Den Haag (NL); Boris Rijnten, Amstelveen (NL); Richard Leeuwenburgh, Berkel en Rodenrijs (NL); Jacob Jan Van Nielen, Heemstede (NL); Henk Heikens Pleizier, Oegstgeest (NL)

(73) Assignee: Bluewater Energy Services B.V., Hoofddorp (NL)

( * ) Notice: Subject to any disclaimer, the term of this patent is extended or adjusted under 35 U.S.C. 154(b) by 176 days.

(21) Appl. No.: 13/402,583

(22) Filed: Feb. 22, 2012

(65) Prior Publication Data

US 2012/0216736 A1 Aug. 30, 2012

(30) Foreign Application Priority Data

Feb. 23, 2011 (EP) ..... 11155577

(51) Int. Cl.
*B63B 21/00* (2006.01)

(52) U.S. Cl.
USPC ..... 114/230.12; 114/293

(58) Field of Classification Search
USPC ..... 114/230.12, 293
See application file for complete search history.

(56) References Cited

U.S. PATENT DOCUMENTS 3,440,671 A * 4/1969 Smulders ..... 441/5
4,490,121 A * 12/1984 Coppens et al. ..... 441/5
4,509,448 A * 4/1985 Pease et al. ..... 114/293
4,604,961 A * 8/1986 Ortloff et al. ..... 114/230.12
4,892,495 A * 1/1990 Svensen ..... 441/5
5,651,708 A * 7/1997 Børseth ..... 441/5
5,860,840 A * 1/1999 Boatman et al. ..... 441/5
5,893,334 A * 4/1999 Poranski, Sr. ..... 114/230.12
5,951,345 A * 9/1999 Perratone et al. ..... 441/4
6,302,048 B1 * 10/2001 Smedal ..... 114/230.12

(Continued)

FOREIGN PATENT DOCUMENTS

EP 1803641 A1 7/2007
WO 9930963 A1 6/1999

OTHER PUBLICATIONS

PCT Search Report for application EP 11155577, Oct. 27, 2011.

*Primary Examiner* — S. Joseph Morano
*Assistant Examiner* — Jovon Hayes
(74) *Attorney, Agent, or Firm* — Steven M. Koehler; Westman, Champlin & Kelly, P.A.

(57) ABSTRACT

A disconnectable mooring system for a vessel is presented, comprising a moonpool in the vessel, a turret structure mounted for a rotation in said moonpool and a buoy member having a plurality of passages each adapted to receive a riser. The turret structure has a lower end comprising a buoy receptacle for detachably receiving the buoy member, wherein the mooring system further comprises a plurality of mooring lines for transmitting mooring forces and each have a lower end and an upper end connected to the seabed and the buoy member, respectively. The mooring lines each comprise a first section which in a disconnectable manner is connected to the turret structure and a second section connected to the first section at a coupling point and connected to the buoy member. Also methods for disconnecting and reconnecting such a mooring system are presented.

19 Claims, 4 Drawing Sheets

(56) References Cited

U.S. PATENT DOCUMENTS

| | | | | |
|---|---|---|---|---|
| 6,453,838 | B1 * | 9/2002 | Mowell et al. | 114/230.13 |
| 6,588,357 | B1 * | 7/2003 | Hobdy | 114/230.1 |
| 6,595,154 | B2 * | 7/2003 | Boatman | 114/230.12 |
| 6,698,372 | B2 * | 3/2004 | Hobdy et al. | 114/230.12 |
| 6,712,560 | B1 * | 3/2004 | Cottrell | 405/224.4 |
| 7,510,452 | B2 * | 3/2009 | Van Tol et al. | 441/5 |
| 2002/0117098 | A1 * | 8/2002 | Boatman | 114/230.12 |
| 2012/0216736 | A1 * | 8/2012 | Heideman et al. | 114/125 |

* cited by examiner

DISCONNECTABLE MOORING SYSTEM AND METHOD FOR DISCONNECTING OR RECONNECTING IT

BACKGROUND

The discussion below is merely provided for general background information and is not intended to be used as an aid in determining the scope of the claimed subject matter.

In a first aspect the invention relates to a disconnectable mooring system for a vessel, comprising a moonpool in the vessel, a turret structure mounted for a rotation in said moonpool and a buoy member having a plurality of passages each adapted to receive a riser, wherein the turret structure has a lower end comprising a buoy receptacle for detachably receiving the buoy member, and wherein the mooring system further comprises a plurality of mooring lines for transmitting mooring forces and each having a lower end and an upper end connected to the seabed and the buoy member, respectively.

Such a disconnectable mooring system is known from EP-B-1 803 641. Under normal operating conditions the mooring forces in the mooring lines are such that during a disconnect the buoy member may be disconnected from the turret structure and may be lowered in a controlled manner to a position away from the vessel and well below sea level. Under specific circumstances however, for example when the vessel is enclosed by drifting pack ice, a disconnect of the buoy member from the turret structure has to be carried out while extremely high mooring forces are transmitted by the mooring lines to the buoy member. Typically such high mooring forces create an asymmetrical load on the buoy member, such that after a disconnect of the buoy member from the turret structure it would tilt in the buoy receptacle and can cause severe damage to the buoy member, risers, umbilicals and/or surrounding structure of the (turret structure of the) vessel.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

An aspect of the present invention includes a disconnectable mooring system wherein the mooring lines each comprise a first section which in a disconnectable manner is connected to the turret structure and a second section is connected to the first section at a coupling point and is also connected to the buoy member. The length of the second section between said coupling point and its connection to the buoy member is chosen such that when the buoy member is received in the buoy receptacle with the first section connected to the turret structure and in a state for transmitting mooring forces, said second section is in a slack state not loaded by said mooring forces.

The mooring forces act directly on the turret structure through the first sections when the buoy member is received in the buoy receptacle. Thus a disconnect of the buoy member from the turret structure and controlled lowering of the buoy member below the turret structure is guaranteed under all circumstances while keeping the vessel stationary (yet able to rotate around the turret), and also when the mooring lines are extremely loaded. The successive disconnect of the first sections from the turret structure then might cause tilting of the buoy member below the turret structure, however without causing any damage to structural parts of the mooring system. After a disconnect of the buoy member from the turret structure and lowering of the buoy member and a successive disconnect of the first sections from the turret structure, the first and second sections of the mooring lines will keep the buoy in position while the vessel is free to move away from the mooring location.

Lowering the buoy member prior to the disconnect of the first sections is not required when the second sections are of sufficient length to reduce the high asymmetrical mooring forces to an acceptable level (to allow the buoy member to lower in a vertical manner) after disconnect of the first sections from the turret structure.

In one embodiment of the disconnectable mooring system, the turret structure comprises turret connectors for connecting said first section to the turret structure wherein each turret connector substantially is located at the coupling point between said first and second sections. This means that the coupling point is located near to the extreme end of the first section. However, it is conceivable too that the coupling point is located at some distance from the turret connector.

In another embodiment, the buoy member comprises buoy connectors for connecting said second sections to the buoy member, wherein the length of a second section is larger than the distance between corresponding turret connectors and buoy connectors when the buoy member is received in the buoy receptacle of the turret structure, and preferably is sufficient to allow the buoy member, when disconnected from the turret structure, to assume a position fully below the lower end of the turret structure.

In yet another embodiment of the disconnectable mooring system, the first section is attached to a first end of a flexible elongate operating line, such as a cable or chain, of which preferably a second end can be attached to and tensioned by a tensioning mechanism that directly or indirectly is connected to the turret structure. By means of such an operating line attaching the mooring line to the turret structure and thereafter possibly tensioning it sufficiently to withstand all expected mooring loads, can be carried out effectively. It should be noted however, that such an operating line also may be provided without said tensioning mechanism, or that such a tensioning mechanism only serves for bringing the first sections in engagement with the turret structure, after which special couplings are activated for attaching the first sections directly to the turret structure.

Further it is possible that the connections between the second sections and the buoy member are of a disconnectable nature. This means that during its normal life span the buoy member remains attached to the second sections of the mooring lines, but that it could be possible to disconnect the buoy member from the second sections for maintenance or replacement of these second sections.

When further means for temporarily ballasting the buoy member and/or first sections of the mooring lines are provided, it is possible to ballast the buoy member and/or first sections to increase the speed with which the buoy member can be lowered.

For example such means for temporarily ballasting the buoy member and/or first sections could comprise a variable ballast tank at the buoy member or a fixed ballast which by appropriate means can be attached to the buoy member or first sections. In the latter case it also is possible that the vessel comprises a hoist with a hoisting cable for placing the fixed ballast on the buoy member and for removing it therefrom and/or a hoist with a hoisting cable provided on the buoy member to position the fixed ballast on the seabed. Such positioning on the seabed preferably will occur when the buoy member or first sections have reached a sufficient depth below sea level.

If provided, a fixed ballast could be suspended below the mooring lines at any point in said lines between the seabed and the buoy member, but preferably at a point in the mooring lines that is supported by a submerged buoyancy can.

In yet another embodiment the vessel may comprise a lifting device with a flexible lifting element, such as a cable, chain or alike, for coupling with the buoy member for lowering or lifting the latter relative to the turret structure. Thus the vertical movements of the buoy member may be controlled and reconnecting the buoy member to the turret structure may be accomplished effectively.

Further it is possible that corresponding first sections and second sections of a mooring line are interconnected by a triangle plate, which offers sufficient degrees of freedom to ensure a proper operation and a prolonged life span of the parts.

Finally it is possible that at the interface between the buoy member and buoy receptacle of the turret structure controllable flow passages for seawater are provided. Opening said passages may increase the speed with which seawater flows around the buoy member and thus increases the speed with which the buoy member may be lowered.

In a second aspect, the present invention relates to a method for disconnecting a disconnectable mooring system for a vessel.

Such a method includes, in an exemplary embodiment, a succession of steps comprising disconnecting the buoy member from the turret structure, lowering the buoy member relative to the turret structure, and disconnecting the first sections of the mooring lines from the turret structure.

In one embodiment, the step of disconnecting the first sections of the mooring lines from the turret structure is carried out when the buoy member has been lowered relative to the turret structure to the lowermost position as allowed by the second sections of said mooring line parts. But, in another embodiment, the disconnection between the first sections and the turret structure could have already occurred at an earlier stage.

In yet another embodiment of said method, the step of lowering the buoy member further comprises the step of ballasting the buoy member and/or opening flow passages for seawater at the interface between the buoy member and buoy receptacle of the turret structure. Thus, the speed with which the buoy member can be lowered may be increased.

In a third aspect, the present invention relates to an alternative method for disconnecting a disconnectable mooring system for a vessel.

Such a method includes, in an exemplary embodiment, a succession of steps comprising disconnecting the first sections of the mooring lines from the turret structure, disconnecting the buoy member from the turret structure before the second sections are taut, and lowering the buoy member relative to the turret structure.

In a fourth aspect the invention relates to a method for reconnecting a disconnected disconnectable mooring system for a vessel.

Such a method includes, in an exemplary embodiment, a succession of steps of lifting the buoy member into position in the buoy receptacle of the turret structure, connecting the buoy member to the turret structure, and connecting the first sections of the mooring lines to the turret structure.

In an embodiment of such a method, the step of connecting the first sections of the mooring lines to the turret structure further comprises the step of attaching said second sections to a tensioning mechanism that directly or indirectly is connected to the turret structure and tensioning said second sections by the tensioning mechanism.

BRIEF DESCRIPTION OF THE DRAWINGS

Hereinafter aspects of the invention will be elucidated while referring to the drawing, in which.

DETAILED DESCRIPTION OF THE ILLUSTRATIVE EMBODIMENTS

Figure 1:
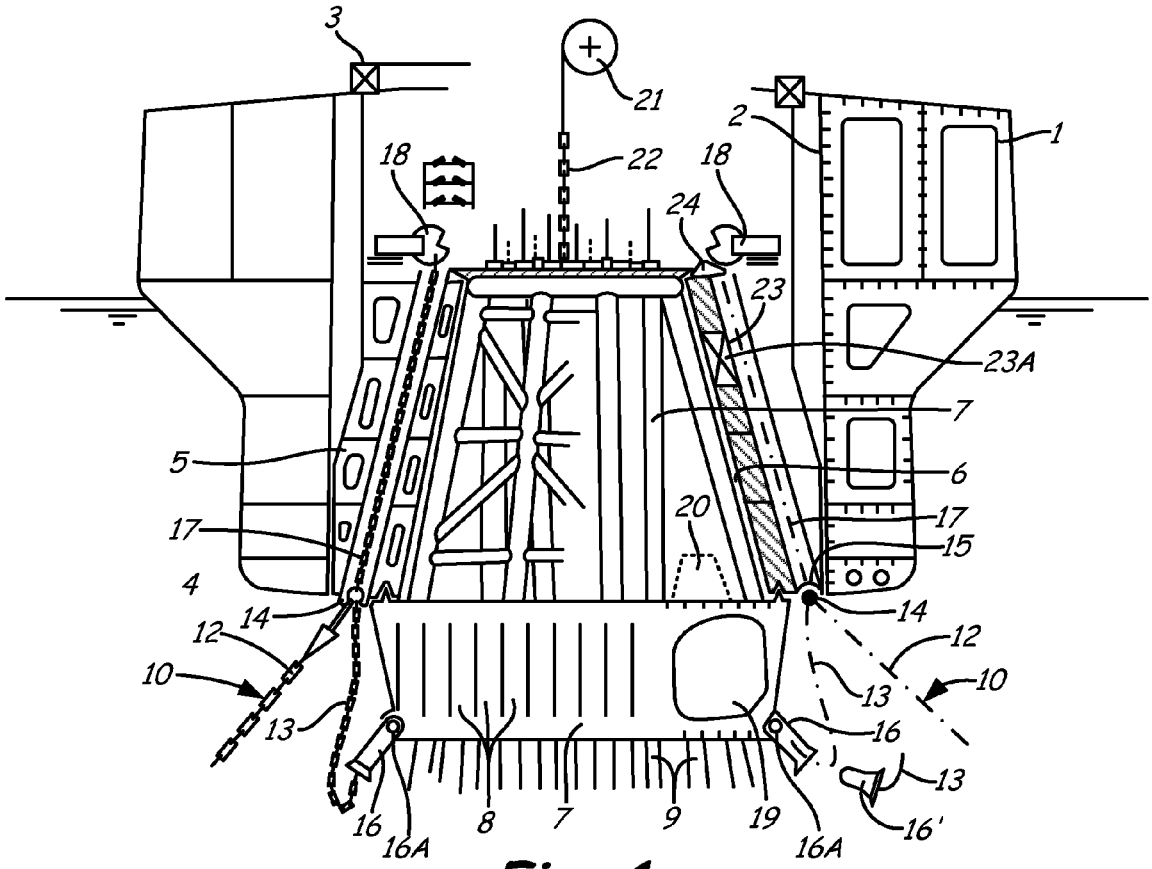
FIG. 1 schematically shows a cross section of an embodiment of the mooring system.

Firstly referring to FIG. 1 a disconnectable mooring system for a vessel 1 is shown in cross section. The vessel 1 comprises a moonpool 2 in which in a manner known per se (e.g. using upper and lower bearings 3 and 4) a turret structure 5 is mounted for rotation. The turret structure 5 has a lower end comprising a buoy receptacle 6 for detachably receiving a buoy member 7. This buoy member 7 has a plurality of passages 8 (schematically illustrated) each adapted to receive a riser 9. The mooring system further comprises a plurality of mooring lines 10 (e.g. anchor chains) for transmitting mooring forces and each having a lower end and an upper end connected to the seabed 11 (see FIG. 5) and the buoy member 7, respectively.

Figure 8:
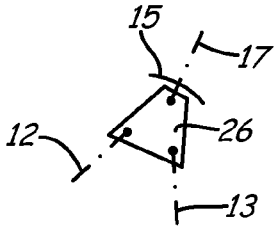

As illustrated each mooring line 10 comprise a first section 12 which in a disconnectable manner (to be explained later) is connected to the turret structure 5 and a second section 13 connected to the first section 12 at a coupling point 14 and which further is connected to the buoy member 7. Corresponding first sections 12 and second sections 13 of a mooring line 10 may be interconnected at said coupling point 14 by means of a triangle plate 26 (FIG. 8).

The length of the second section 13 between said coupling point 14 and its connection to the buoy member 7 is chosen such that when the buoy member 7 is received in the buoy receptacle 6 with the first section 12 connected to the turret structure 5 and in a state for transmitting mooring forces (thus a state according to FIG. 1), said second section 13 is in a slack state not loaded by said mooring forces.

The turret structure 5 comprises turret connectors 15 for connecting said first section 12 to the turret structure 5, wherein in the illustrated embodiment each turret connector 15 substantially is located at or near the coupling point 14 between said first and second sections 12 and 13. Such a turret connector 15 may comprise a pivoting device (e.g. single or double pivot device) or any type of controllable coupling.

The buoy member 7 likewise comprises buoy connectors 16 for (permanently or semi-permanently) connecting said second sections 13 to the buoy member (which connections between the second sections and the buoy member may be of a non-disconnectable or disconnectable nature). FIG. 1 illustrates that connector 16 can be disconnectable with connector 16' spaced apart from buoy member 7 with dashed lines. Any suitable fastening mechanism such as a bolt 16A mating with a suitable nut (not shown) can be used. Without limitation other types of fasteners include clasps, clamps etc. The fastening mechanism can be manipulated by, for example, by remotely operated vehicles.

The length of a second section 13 is larger than the distance between corresponding turret connectors 15 and buoy connectors 16 when the buoy member 7 is received in the buoy receptacle 6 of the turret structure 5. Preferably said length is sufficient to allow the buoy member 7, when disconnected from the turret structure 5, to assume a position fully below the lower end of the turret structure 5 or vessel 1 (as will appear later).

In the illustrated embodiment of the mooring system, each first section 12 is attached to a first end of a flexible elongate operating line 17, such as a cable or chain, of which a second end can be attached to and tensioned by a tensioning mechanism 18 that directly or indirectly is connected to the turret structure 5. The tensioning mechanism 18 may provide the connection between the first sections 12 and the turret structure 5, but it is also possible that it only serves to bring the first sections 12 into a position in which a coupling can be achieved at the turret connectors 15.

There may be provided means for temporarily ballasting the buoy member with ballast, such as from a variable ballast tank 19 at the buoy member 7. As an alternative said means for temporarily ballasting the buoy member 7 may comprise a ballast weight 20 (illustrated schematically in FIGS. 1 and 5) which by appropriate means (such as for example a hoist 27 with a hoisting cable 28) can be attached to the buoy member 7 and removed therefrom. It should be noted the ballast (e.g. ballast weight 20) may be suspended from the buoy member 7 or first sections 12 (as illustrated) of the mooring lines. The also might be positioned on the seabed 11 when the buoy member 7 and/or first sections 12 have reached a required depth below sea level as illustrated with dashed lines of ballast weight 20'.

The vessel further comprises a lifting device 21 (e.g. winch, hoist, etc.) with a flexible lifting element 22, such as a cable, chain or alike, for coupling with the buoy member 7 for lowering or lifting the latter relative to the turret structure 5.

Finally, FIG. 1 shows schematically that at the interface between the buoy member 7 and buoy receptacle 6 of the turret structure 5, at least one flow passage 23 (one of which is illustrated by way of example where location and shape of the passage 23 is indicated schematically) for seawater may be provided, the function of which will appear later.

The operation of the mooring system firstly will be explained by a method for disconnecting the disconnectable mooring system, as illustrated in FIGS. 2-5.

Figure 2:
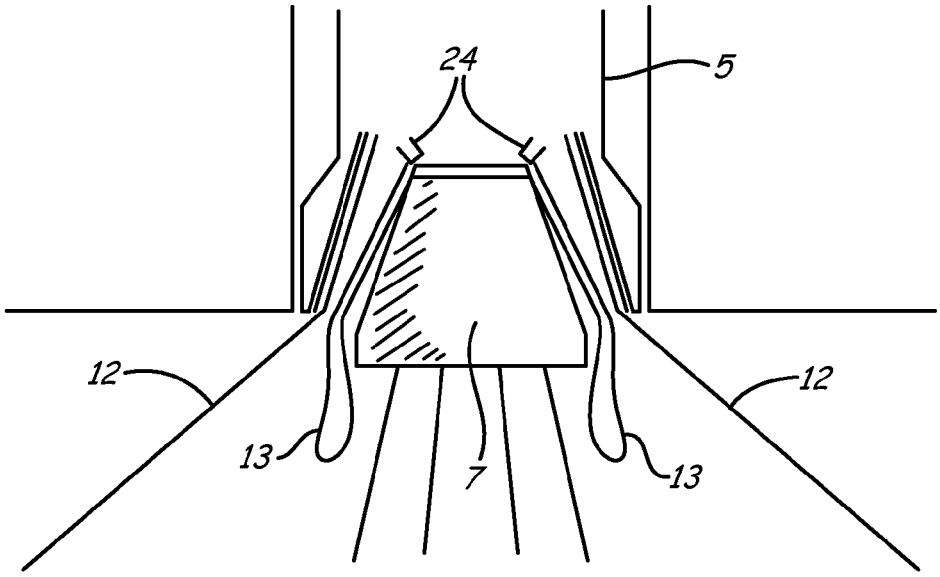
FIGS. 2-5 schematically show successive steps of a method for disconnecting a mooring system, FIGS. 6 and 7 schematically show successive steps of a method for reconnecting a mooring system, and FIG. 8 schematically shows a triangle connecting plate.

FIG. 2 shows the step of disconnecting the buoy member 7 from the turret structure 5, for example by disconnecting locks 24 between the buoy member 7 and turret structure 5. The first sections 12 of the mooring lines are still connected to the turret structure 5 and the second sections 13 are slack.

Figure 3:
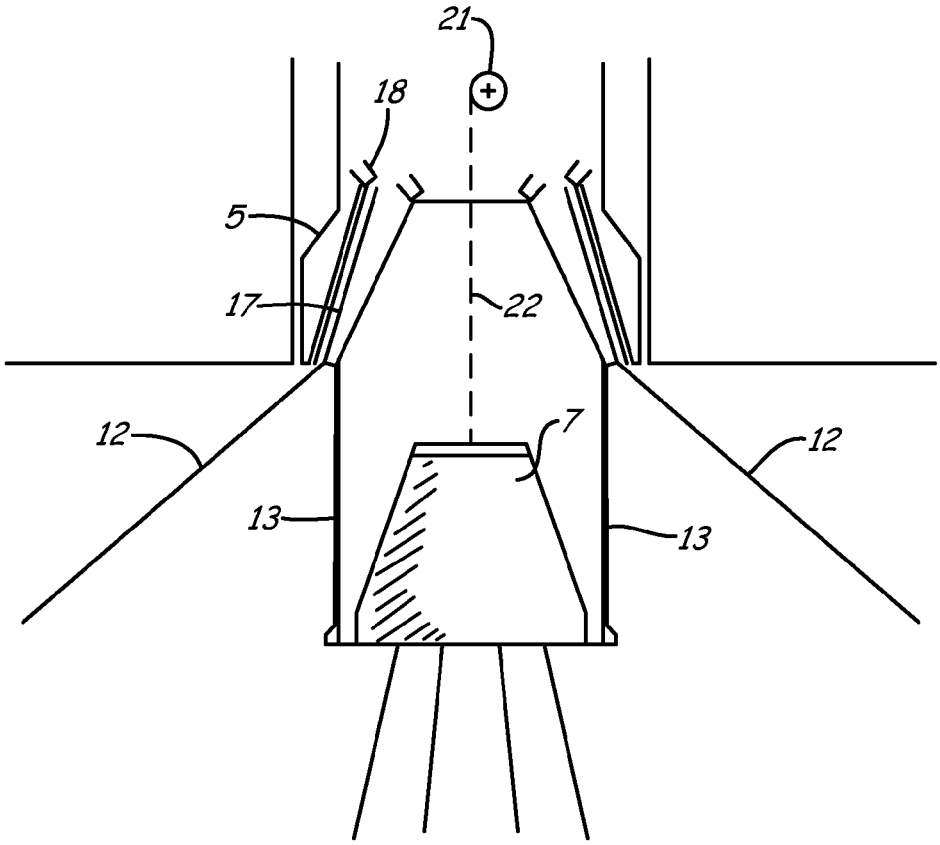

After unlocking the locks 24, the buoy member 7 is lowered relative to the turret structure 5 as illustrated in FIG. 3. This lowering may occur freely under influence of any of the mooring, riser and umbilical force, the gravitational force and buoyancy forces, but also may be controlled by the lifting device 21 with cable 22. The flow passage(s) 23 allow seawater to flow into the space above the buoy member 7. Further, if desired, it is possible to control the flow of sea water through each passage 23 (FIG. 1) by using a valve 23A, which is illustrated schematically. During this stage of lowering the buoy member 7 the first sections 12 remain connected to the turret structure 5 (e.g. by means of the turret connectors 15 or the operating lines 17 which are connected to the tensioning mechanisms 18) and the position of the vessel is maintained stationary. Finally the buoy member 7 reaches a position in which the second sections 13 of the mooring lines also are tensioned (as illustrated in FIG. 3).

Figure 4:
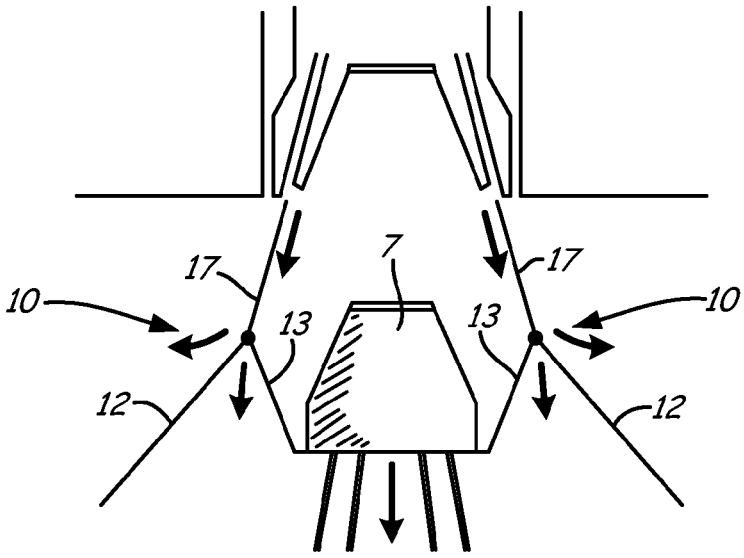
Figure 5:
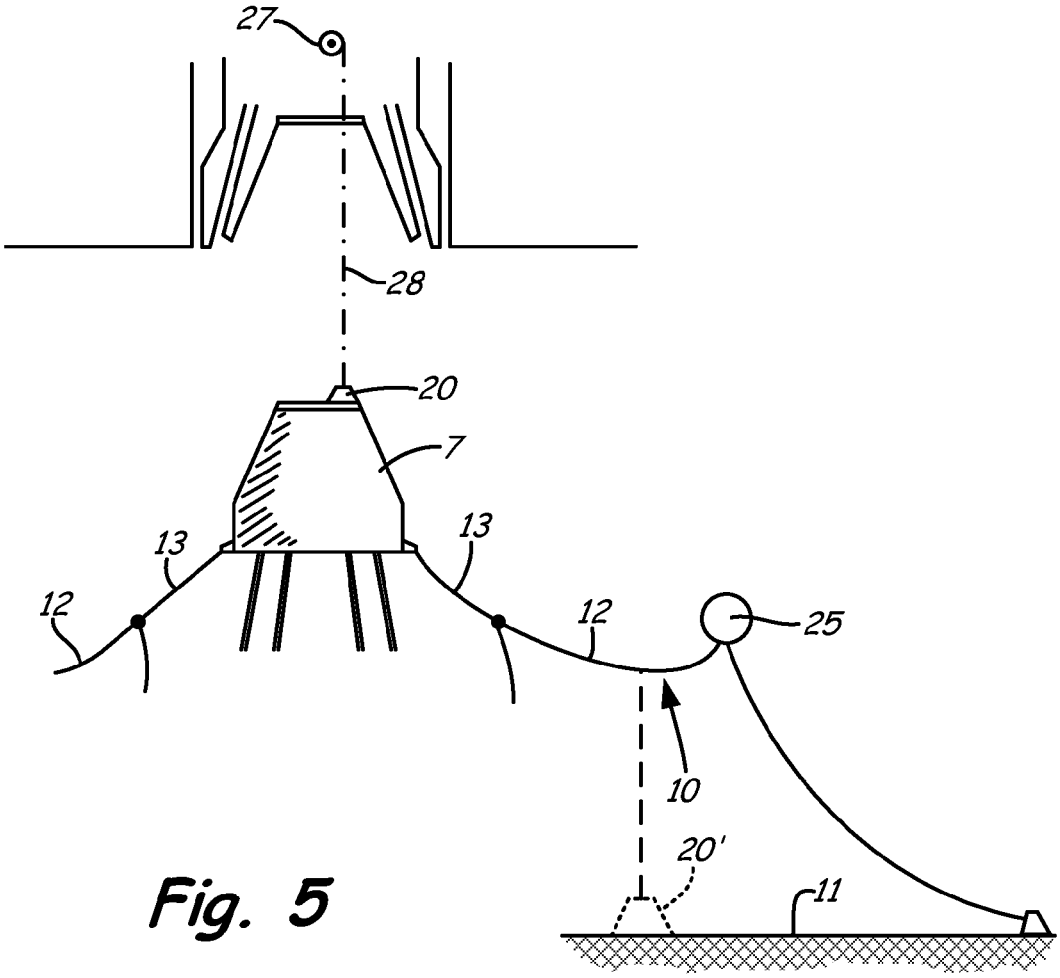

Next the first sections 12 of the mooring lines are disconnected from the turret structure 5 (e.g. by releasing the turret connectors 15, or the operating lines 17 from the tensioning mechanisms 18) and the mooring lines 10 will move downward by gravity as illustrated in FIG. 4. At the same time the buoy member 7 also will move downward further until reaching a balanced position in which it floats at a specific depth below sea level (FIG. 5). The first and second sections 12,13 now are positioned in line for transmitting mooring forces to the buoy member 7. As known per se, auxiliary buoys 25 may be provided to keep the mooring lines 10 in a desired catenary shape.

In the described embodiment of this method the step of disconnecting the first sections 12 of the mooring lines 10 from the turret structure 5 is carried out when the buoy member 7 has been lowered relative to the turret structure 5 to the lowermost position as allowed by the second sections 13 of said mooring lines. In a further embodiment, the first sections 12 can be disconnected already at an earlier stage, but after that the buoy member 7 has reached a sufficiently low position that there is no risk anymore that a tilting (or other motion) of the buoy member may damage the vessel or turret structure. It is even possible to disconnect the first sections 12 already before the buoy member 7 is disconnected, but before the second sections 13 have become taut.

Further it is noted that the step of lowering the buoy member 7 further may comprise the step of (temporarily) ballasting the buoy member 7 (using the ballast tank 19 or ballast weight 20).

Figure 6:
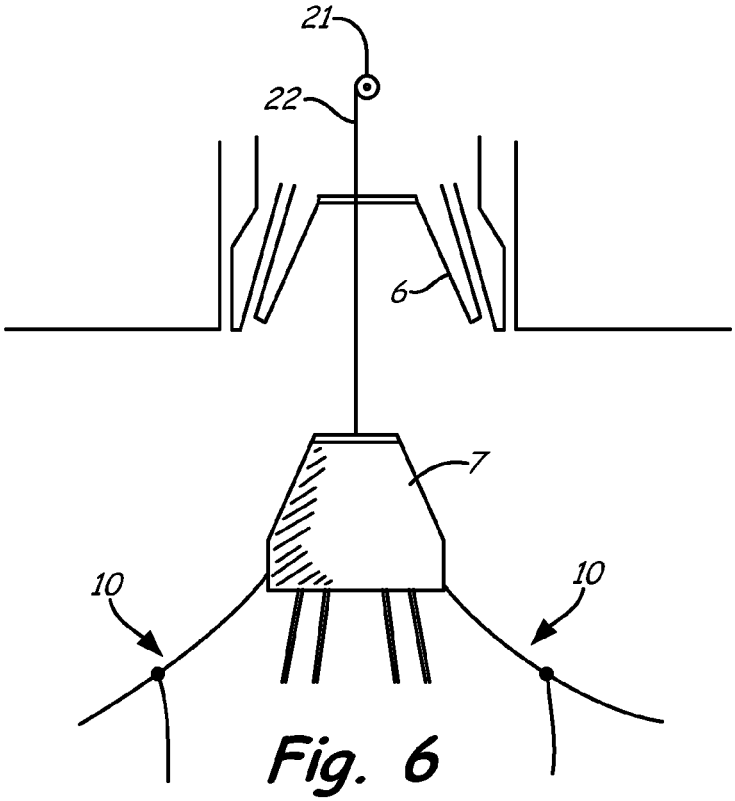
Figure 7:
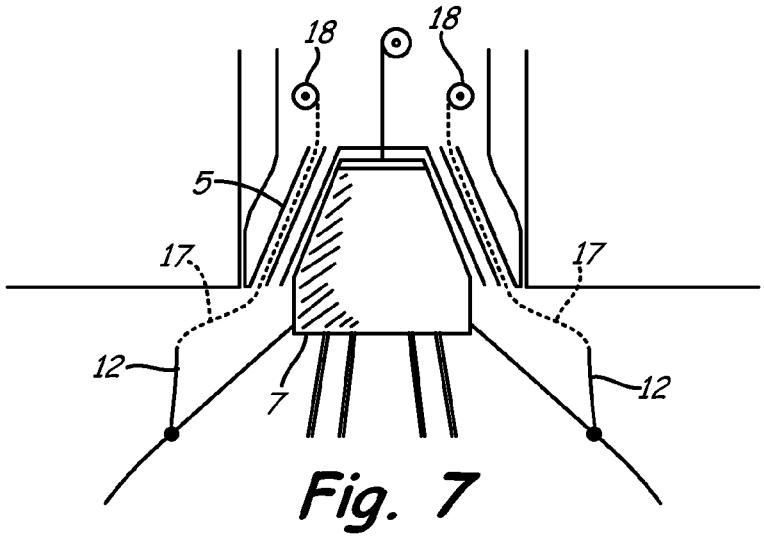

Next a method for again reconnecting a disconnected disconnectable mooring system is described while referring to FIGS. 6 and 7. Firstly (FIG. 6) the buoy member 7 is lifted into position in the buoy receptacle 6 of the turret structure 5 using the lifting device 21 with cable 22. Passage(s) 23, if present, can allow sea water to escape the upper portion of the buoy receptacle 6 as the turret structure is received therein, where valve 23A, if present, can be used to control the flow through the passage 23.

After having reached said position (FIG. 7) the buoy member 7 is connected to the turret structure 5, for example by locks 24. The first sections 12 then are connected to the turret structure 5 using the operating lines 17. It is noted that the pick up of a line (such as the first section) using such an operating line is a known technique (which for example may be carried out by remotely operated vehicles) and thus does not need a detailed explanation here.

The step of connecting the first sections 12 of the mooring lines 10 to the turret structure 5 further may comprise the step of attaching said second sections 13 to a tensioning mechanism 18 that directly or indirectly is connected to the turret structure 5 and tensioning said second sections by the tensioning mechanism 18.

Although the subject matter has been described in language directed to specific environments, structural features and/or methodological acts, it is to be understood that the subject matter defined in the appended claims is not limited to the environments, specific features or acts described above as has been held by the courts. Rather, the environments, specific features and acts described above are disclosed as example forms of implementing the claims. The number of second sections 13 may differ from the number of first sections 12; it is possible, for example, that a plurality of second sections 13 are connected to the same first section 12.

What is claimed is:

1. A disconnectable mooring system for a vessel, comprises:

a moonpool in the vessel; a turret structure rotatably mounted in said moonpool, wherein the turret structure has a lower end comprising a buoy receptacle;

a buoy member disposed in the buoy receptacle, the buoy member having a plurality of passages that each receive a riser, and wherein the buoy member is removable from the buoy receptacle; and a plurality of mooring lines, each mooring line having a lower end and an upper end connected to the seabed and the buoy member, respectively, wherein each mooring line comprises a first section which in a disconnectable manner is connected to the turret structure and a second section connected to the first section at a coupling point, the second section further being connected to the buoy member, wherein a length of the second section between said coupling point and a connection to the buoy member is chosen such that when the buoy member is received in the buoy receptacle with the first section connected to the turret structure, said second section is in a slack state.

2. The disconnectable mooring system according to claim 1, wherein the turret structure comprises turret connectors connecting said first section to the turret structure and wherein each turret connector substantially is located at the coupling point between said first and second sections.

3. The disconnectable mooring system according to claim 2, wherein the buoy member comprises buoy connectors connecting said second sections to the buoy member, wherein the length of a second section is larger than a distance between corresponding turret connectors and buoy connectors when the buoy member is received in the buoy receptacle of the turret structure.

4. The disconnectable mooring system according to claim 1 and further comprising a plurality of tensioning mechanisms secured to the turret structure each having a flexible elongate operating line with a remote end secured to one of the first sections.

5. The disconnectable mooring system according to claim 1, and further comprising a disconnectable coupling connecting each second section to the buoy member.

6. The disconnectable mooring system according to claim 1 and further comprising ballast operable with the the buoy member and/or first sections of the mooring lines.

7. The disconnectable mooring system according to claim 6, wherein said ballast comprises a variable ballast tank at the buoy member.

8. The disconnectable mooring system according to claim 6, wherein said ballast comprises a fixed ballast operably coupled the buoy member or first sections.

9. The disconnectable mooring system according to claim 8, wherein the vessel comprises a hoist having a hoisting cable configured to place the fixed ballast on the buoy member and for removing the fixed ballast therefrom and/or hoist with a hoisting cable provided on the buoy member to position the fixed ballast on the seabed.

10. The disconnectable mooring system according to claim 1, wherein the vessel comprises a lifting device with a flexible lifting element configured to couple with the buoy member and lower or lift the buoy member relative to the turret structure.

11. The disconnectable mooring system according to claim 1, wherein corresponding first sections and second sections of a mooring line are interconnected by a triangle plate.

12. The disconnectable mooring system according to claim 1, and further comprising at least one flow passage for sea water at the interface between the buoy member and buoy receptacle of the turret structure.

13. The disconnectable mooring system according to claim 12 and further comprising a valve to control flow through the flow passage.

14. A method for disconnecting a disconnectable mooring system for a vessel, the mooring system having a turret structure rotatably mounted in a moonpool of the vessel, wherein the turret structure has a lower end comprising a buoy receptacle, and wherein a buoy member is disposed in the buoy receptacle, and wherein the buoy member is removable from the buoy receptacle, and a plurality of mooring lines, each mooring line having a lower end and an upper end connected to the seabed and the buoy member, respectively, wherein each mooring line comprises a first section which in a disconnectable manner is connected to the turret structure and a second section connected to the first section at a coupling point and to the buoy member, wherein a length of the second section between said coupling point and a connection to the buoy member is chosen such that when the buoy member is received in the buoy receptacle with the first section connected to the turret structure, said second section is in a slack state, the method comprising:

disconnecting the buoy member from the turret structure;

lowering the buoy member relative to the turret structure;

and disconnecting the first sections of the mooring lines from the turret structure.

15. The method according to claim 14, wherein disconnecting the first sections of the mooring lines from the turret structure is carried out when the buoy member has been lowered relative to the turret structure to the lowermost position as allowed by the second sections of said mooring line parts.

16. The method according to claim 14, wherein lowering the buoy member further comprises providing ballast to the buoy member.

17. A method for disconnecting a disconnectable mooring system for a vessel, the mooring system having a turret structure rotatably mounted in a moonpool of the vessel, wherein the turret structure has a lower end comprising a buoy receptacle, and wherein a buoy member is disposed in the buoy receptacle, and wherein the buoy member is removable from the buoy receptacle, and a plurality of mooring lines, each mooring line having a lower end and an upper end connected to the seabed and the buoy member, respectively, wherein each mooring line comprises a first section which in a disconnectable manner is connected to the turret structure and a second section connected to the first section at a coupling point and to the buoy member, wherein a length of the second section between said coupling point and a connection to the buoy member is chosen such that when the buoy member is received in the buoy receptacle with the first section connected to the turret structure, said second section is in a slack state, the method comprising:

disconnecting the first sections of the mooring lines from the turret structure;

disconnecting the buoy member from the turret structure before the second sections are taut; and lowering the buoy member relative to the turret structure.

18. A method for reconnecting a disconnected disconnectable mooring system for a vessel the mooring system having a turret structure rotatably mounted in a moonpool of the vessel, wherein the turret structure has a lower end comprising a buoy receptacle, and wherein a buoy member is disposed in the buoy receptacle, and wherein the buoy member is removable from the buoy receptacle, and a plurality of mooring lines, each mooring line having a lower end and an upper end connected to the seabed and the buoy member, respectively, wherein each mooring line comprises a first section which in a disconnectable manner is connected to the turret structure and a second section connected to the first section at a coupling point and to the buoy member, wherein a length of the second section between said coupling point and a connection to the buoy member is chosen such that when the buoy member is received in the buoy receptacle with the first section connected to the turret structure, said second section is in a slack state, the method comprising:

lifting the buoy member into position in the buoy receptacle of the turret structure; connecting the buoy member to the turret structure; and connecting the first sections of the mooring lines to the turret structure.

19. The method according to claim 18, wherein connecting the first sections of the mooring lines to the turret structure further comprises attaching said second sections to a tensioning mechanism that directly or indirectly is connected to the turret structure and tensioning said second sections by the tensioning mechanism.

* * * * *